United States Patent [19]

Weinberg et al.

[11] Patent Number: 4,508,167

[45] Date of Patent: Apr. 2, 1985

[54] SELECTIVE CASING BORE RECEPTACLE

[75] Inventors: Roger A. Weinberg, Houston; Mark C. Glaser, Bellaire, both of Tex.

[73] Assignee: Baker Oil Tools, Inc., Orange, Calif.

[21] Appl. No.: 519,392

[22] Filed: Aug. 1, 1983

[51] Int. Cl.[3] ..... E21B 23/02

[52] U.S. Cl. ..... 166/120; 166/382; 166/387

[58] Field of Search ..... 166/120, 122, 134, 138, 166/216, 382, 387

[56] References Cited

U.S. PATENT DOCUMENTS

| | | | |
|---|---|---|---|
| 3,011,549 | 12/1961 | Fredd | 166/46 |
| 3,382,927 | 5/1968 | Davis, Jr. | 166/124 |
| 3,412,790 | 11/1968 | Brown | 166/4 |
| 4,369,840 | 1/1983 | Szarka | 166/214 |
| 4,372,393 | 2/1983 | Baker | 166/382 |
| 4,399,873 | 8/1983 | Lindsey, Jr. | 166/380 |

*Primary Examiner*—Stephen J. Novosad
*Assistant Examiner*—Bruce M. Kisliuk
*Attorney, Agent, or Firm*—Norvell & Associates

[57] ABSTRACT

An annular packoff assemblage is provided for selective engagement with any one of a plurality of casing seal bore receptacles spaced along a casing string. The packoff assemblage includes an upper latching assemblage for cooperation with an upwardly facing no-go shoulder providing in the selected seal bore receptacle, an intermediate annular sealing assemblage for establishing sealing integrity between an inner mandrel and the polished internal bore of the selected seal bore receptacle, and a lower latching assemblage movable into latching engagement with the downwardly facing surface provided at the end of the seal bore of the casing receptacle. In two embodiments of the invention, upward movement of the tubing string, followed by a turning movement and a downward movement will effect the releasing of both the upper and lower latching elements to move outwardly into latching engagement with the respective surfaces in the selected casing receptacle. In another modification of the invention, the upper latching assembly includes a collet whose ring portion functions as a piston in a fluid pressure chamber so that it may be moved to a latching position through the application of fluid pressure within the bore of the mandrel.

29 Claims, 25 Drawing Figures

SELECTIVE CASING BORE RECEPTACLE

BACKGROUND OF THE INVENTION

1. Field of the Invention

This invention relates to sealing and packing systems used in subterranean oil and gas wells for providing an annular seal between a fluid transmission conduit disposed in another conduit, the most common example being to provide an annular seal between production tubing and a casing receptacle at a selected location.

2. Description of the Prior Art

There are many different downhole tools in the oil and gas industry which require that a seal be established in the annulus between a fluid transmission conduit or tubing string disposed in a well bore and the outer well casing. These tools may relate to the drilling and completion of the well, the production of the well, the servicing of the well, or the abandonment of the well. Conventional packers, employing an anchoring system for holding a sealing element in position against either upwardly or downwardly acting pressure differentials, are most often employed for establishing this seal. These conventional packets generally employ radially expandable anchor slip systems and radially expandable packing or sealing elements to prevent fluid communication and to provide pressure integrity. Such packets are typically run in and set in place either by or on a tubing string or a wireline setting tool. When set using a tubing string, the packer is typically set using hydraulic pressure in the tubing, hydrostatic pressure in the well bore, or a combination of both. It may also be mechanically set by the weight of the tubing. These packers can be permanent type packers with an internal seal bore for receiving tubing which can be retrieved while leaving the packer in place. Retrievable packers, employing techniques such as rotary manipulation of the tubing string to release anchor slip assemblies and packing elements for retrieval of the packing element, are also commonly employed.

It is generally necessary that sealing integrity be established between separate elements within the tubing string or between accessory items and the tubing string. For example, it is generally necessary that a tubing section, inserted into a seal bore of a packer, must have sealing integrity between that section and the packer. One means of providing such sealing integrity is to utilize stacks of sealing elements in which individual sealing elements have a generally chevron-shaped cross-section. Sealing systems employing such chevron-shaped sealing elements are depicted on page 672 of the 1980–1981 Composite Catalog of Oilfield Equipment and Services published by Work Oil. These chevron-shaped sealing elements and systems, commonly referred to as tubing seal systems, are generally employed to establish a seal between a tubing mounted element and the internal seal bore of a conventional packet. An alternative method of establishing a seal between a conventional packer and tubing elements while still permitting movement of the tubing elements relative to the packer, is depicted in U.S. Pat. No. 3,109,490 covering a slidable latching seal assembly.

In addition to the use of conventional packing elements to provide sealing integrity in the tubing casing annulus and to isolate the production zone from portions of the annulus extending above the packing element, casing polished bore receptacles have been employed in conjunction with sealing elements to achieve some of the objectives achieved by conventional packers. A typical prior art example of the use of packoff assemblies in conjunction with casing bore receptacles, or liners, is discussed on pages 6438 and 6439 of the 1978–79 Composite Catalog of Oilfield Equipment and Services published by World Oil.

In U.S. Pat. No. 4,372,393 to Baker, there is disclosed and claimed a packoff assembly which can be used in conjunction with a casing bore receptacle and a tubing mounted mandrel to provide a tubing-casing annular seal and to permit isolation of the production zone from the tubing-casing annulus. Such packoff assembly can be positioned at a precise location in the casing and will permit tubing movement which may result during a production or treating cycle.

Tubing movement is especially significant in deep hot wells. In deep hot wells, the tubing is originally landed at more or less an ambient well temperature. During treating operations, for example, if a cold acid is pumped down the tubing, the tubing would tend to undergo contraction. The tubing will elongate if heated by produced fluids. Some means for permitting tubing movement must therefore be provided. Tubing may tend to shrink because of a ballooning effect or as a result of helical buckling. The tubing may also be subjected to compressive force, sometimes referred to as "piston effect", tending to shorten the tubing. This force is due to differential pressure acting on the end area of the tubing and that portion of a packoff assembly extending between the tubing and casing. The invention of the aforementioned patent provides a means for attaching the tubing casing packoff assembly to the casing, thus eliminating any piston effect. By attaching the packoff assembly directly to the casing receptacle, the only force acting on the tubing would be that force developed by the pressure differential acting on the cross-sectional area of the tubing itself.

The structure disclosed in said Baker patent also permits the use of tubing seal systems to accomplish the sealing function otherwise achieved by the use of conventional radially expanding packing elements. With such construction, the cross-sectional area or gap across which the sealing elements must bridge is much less than that encountered when conventional packing elements are used. Significant radial expansion of the sealing elements themselves is therefore eliminated.

Conventional radially expanding packing elements generally required a complex means of expanding the packing element into, and maintaining it in sealing engagement with the surface to be sealed. This means is sometimes further complicated by the necessity of providing expanding packing element retaining means to prevent extrusion of the packing element through the gap that it must bridge. On the other hand, the elements of tubing seal systems are energized by the pressure which they contain. They therefore need no mechanism to expand them and since the metal elements that retain them fit the sealing surface closely, there can be a very small gap that the seals must bridge. Contraction of the packoff assembly using a tubing seal system is, therefore, much more simple than one using conventional radially expanding packing elements.

The specific apparatus disclosed in the aforementioned Baker patent relied upon the expansion of collet arms to effect the securement of the packoff assembly to the casing receptacle. Such collet arms were forced outwardly into their latching position by a relative downward movement of the polished external surface of the mandrel which also cooperated in sealing relationship with internal seals of the packoff assembly. As the mandrel moved up and down in response to expansion or contraction movements of the tubing string, there was continuous frictional contact between the collet arms and the polished mandrel surface, thus creating the possibility of scratching and in any event producing a brinelling or localized hardening of the polished seal surface which adversely affected its cooperation with the internal seals of the packoff assembly.

Copending application Ser. No. 432,210, filed Oct. 1, 1982, provides an annular packoff member for cooperation with a casing bore receptacle defining an internal polished surface. A tubing carried mandrel, having a polished external surface, is utilized to run the packoff assembly into the casing and, when the packoff assembly is anchored to the casing receptacle through the outward camming of the radial arms of a collet, the polished external surface of the mandrel cooperates in sealing relationship with internal seals of the packoff assembly. The collet arms are initially retained in a fixed, contracted position in a recessed lower portion of the mandrel by a retaining sleeve. After run-in to a position adjacent the casing seal bore receptacle, pressurized fluid is supplied to the annulus between the tubing string and the casing wall to maintain a downward force on the packoff assemblage. Upward movement of the mandrel produced by lifting the tubing string then effects the shearing of a shear pin which holds the collet arm retaining sleeve in a fixed position relative to the mandrel. Subsequent downward movement of the mandrel effects the release of the collet arm retaining sleeve from the collet arms and concurrently moves a peripherally spaced array of radially shiftable locking dogs, carried by a lock support sleeve surrounding the mandrel, into adjacent relationship with respect to recesses provided on the internal sides of the collet arms, thus locking the collet arms in their expanded position wherein upwardly facing shoulders on the collet arms engage a downwardly facing shoulder on the receptacle sleeve. The collet is supported by the support sleeve rather than the polished surface of the mandrel in the set position.

In all of the aforedescribed prior art devices, the positioning of the packoff assembly with respect to the casing sealing bore receptacle was primarily determined by an upwardly facing no-go shoulder conventionally provided on the seal bore receptacle. Such no-go shoulder cooperated with a downwardly facing shoulder provided on the packoff assemblage. With the great depth of modern wells, it is often desirable to incorporate a plurality of casing seal bore receptacles in the casing string spaced at intervals along the string. The packoff assemblies of the prior art could not be utilized to be selectively positioned in engagement with any selected one of the plurality of seal bore receptacles. There is, therefore, a distinct need for a packoff assembly which may be locked in sealing engagement with any selected one of a plurality of casing seal bore receptacles spaced along the length of the casing string.

SUMMARY OF THE INVENTION

The instant invention provides an annular packoff assemblage for cooperation with any selected one of a plurality of identical casing seal bore receptacles mounted in the casing string. A tubing carried mandrel, having a polished external cylindrical surface, is utilized to run the packoff assembly into the casing. Such mandrel carries not only a set of radially outwardly cammable latch arms for engagement with the downwardly facing latching surface conventionally provided at the bottom end of the seal bore, but additionally carries a radially expansible locking element which is expandable into abutting engagement with the upwardly facing latching surface conventionally provided above the seal bore of the casing seal bore receptacle.

The lower latching assembly may comprise the unit described in the aforementioned copending application, Ser. No. 432,210, filed Oct. 1, 1982. The latching arms of such assemblage are settable by an upward movement of the tubing string, on which the mandrel is carried, followed by a downward movement of the tubing string. In accordance with this invention, a latching assemblage for the upwardly facing shoulder of the casing bore receptacle is, in one embodiment, operable by the same upward movement of the tubular string followed by a downward movement. Between the upward and downward movements of the tubing string, however, the tubing string is rotated to effect the shifting of position of a pin in a J slot, which pin is employed to maintain the upper latching assemblage in a non-expanded, retracted position until the aforementioned sequence of tubing string movements are accomplished.

In another embodiment of the invention, the upper latching arms are retained in an inoperative position by a retention sleeve. The latching arms of a collet are operatively connected to an annular piston mounted within the retention sleeve and fluid pressure is applied to such piston to effect the movement of the collet arms upwardly out of engagement with the retaining sleeve. A spring-type latch prevents return movement of the latching arms so that the subsequent upward and downward movement of the tubing string to effect the latching engagement of the lower latching arms of the packoff assemblage concurrently effects the latching engagement of the upper arms with the upwardly facing shoulder of the casing bore receptacle.

Further advantages of this invention will be readily apparent to those skilled in the art from the following detailed description, taken in conjunction with the annexed sheets of drawings, on which are shown several preferred embodiments of the invention.

DESCRIPTION OF PREFERRED EMBODIMENT

Figure 1A:
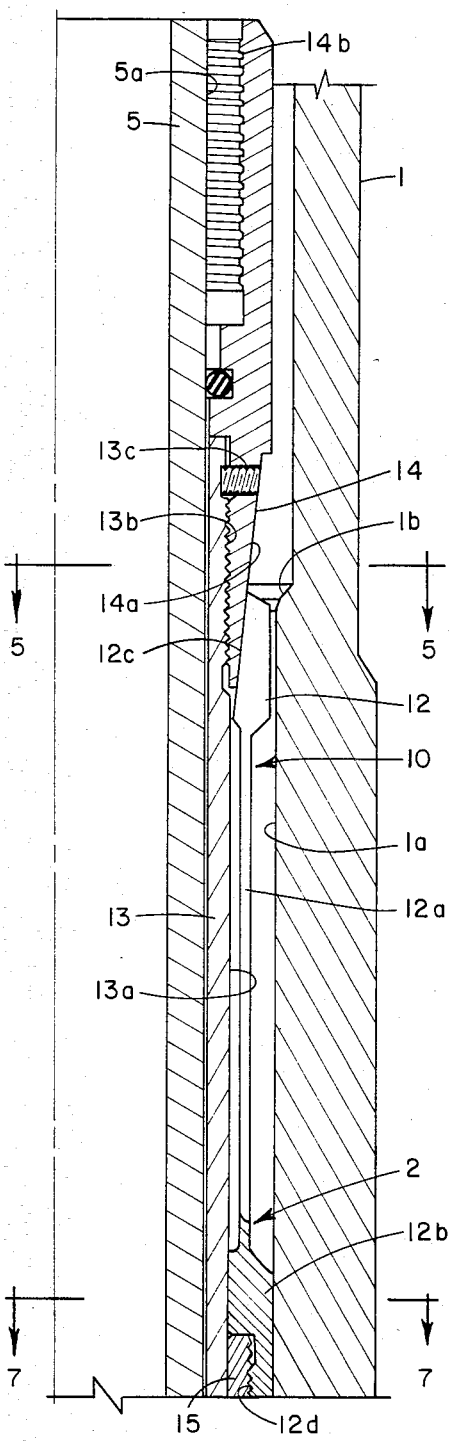
FIGS. 1*a*, 1*b*, 1*c*, 1*d*, and 1*e* collectively represent a vertical, quarter sectional view of a packoff assemblage embodying this invention shown in its run-in position with respect to a casing seal bore receptacle.
Figure 1B:
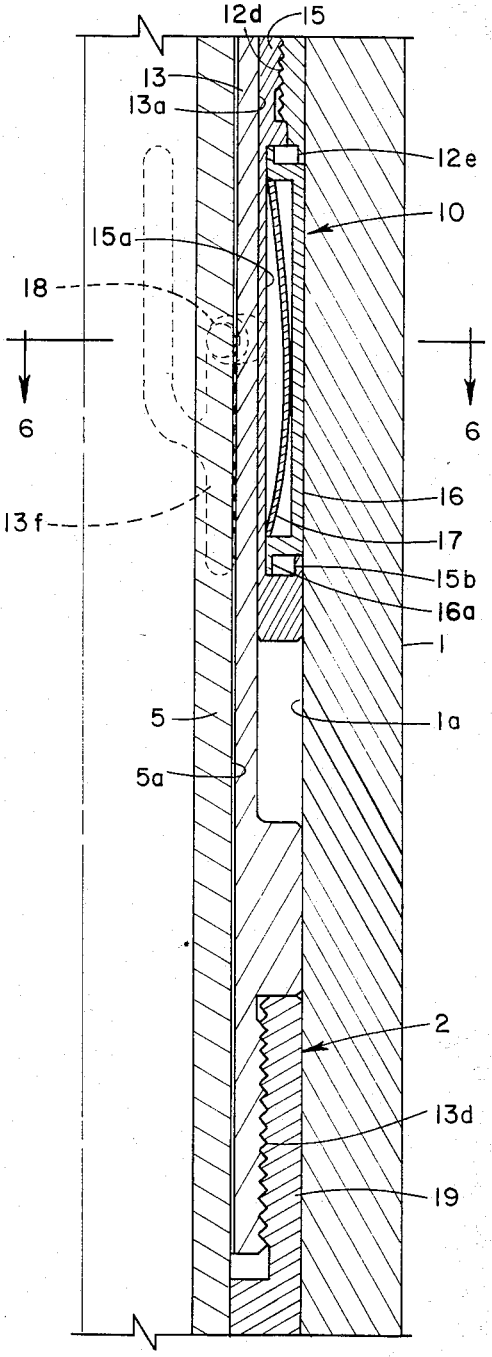
Figure 1C:
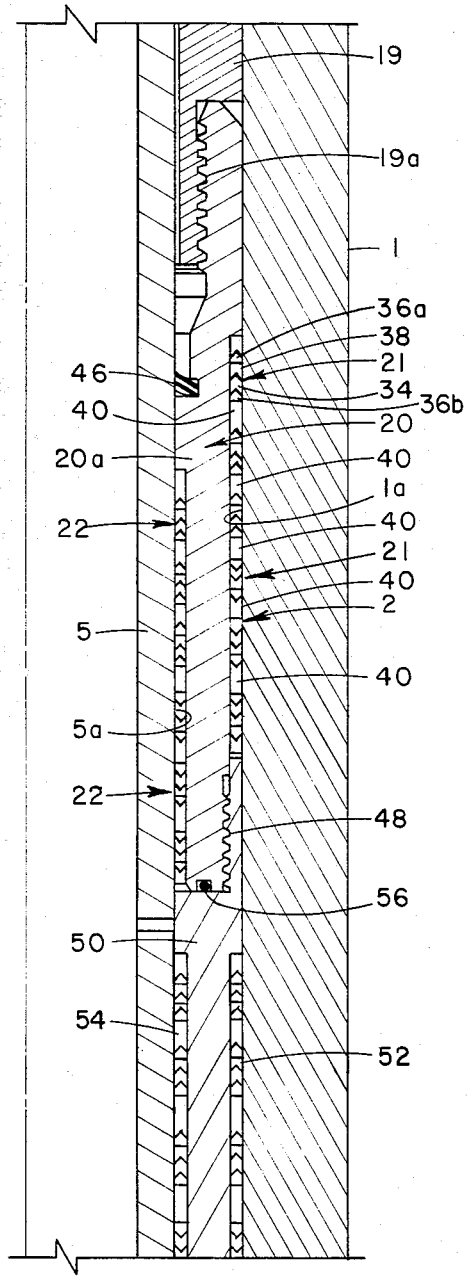
Figure 1D:
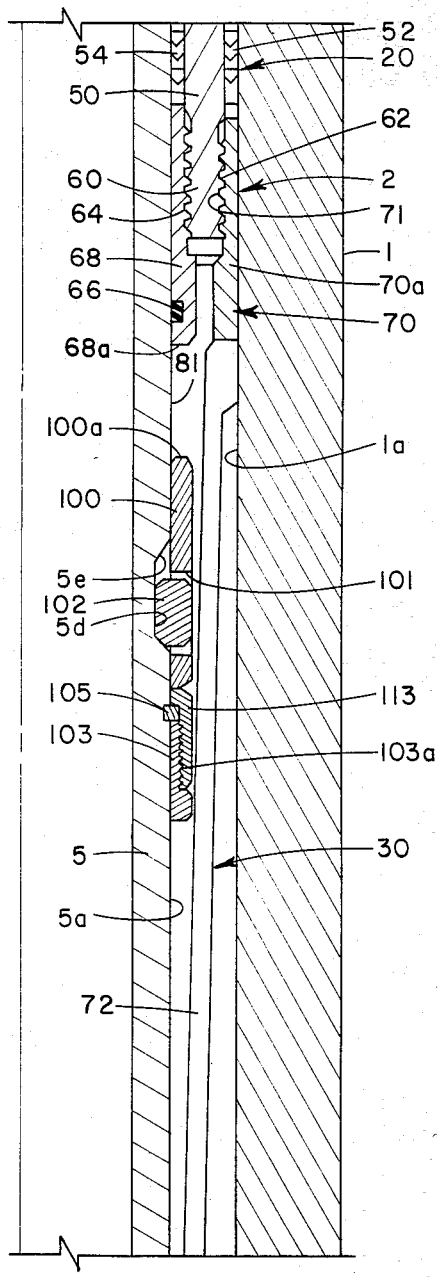

Referring to FIGS. 1*a*, 1*b*, 1*c*, 1*d*, and 1*e*, there is shown a casing seal bore receptacle 1. It will be understood that this seal bore receptacle is of conventional configuration defining an internal, axially elongated seal bore surface 1*a* and having an upwardly facing latching surface 1*b* at its upper end and a downwardly facing latching surface 1*c* at its lower end. Seal bore receptacle 1 is threadably connected in conventional fashion in the casing string 1*d* as by threads 1*e* (FIG. 1*e*) and a plurality of substantially identical receptacles are normally provided in the casing string in vertically spaced relationship. The particular receptacle 1 illustrated is that selected by the operator for engagement therewith of an annular packoff asemblage 2 which, in FIGS. 1*a*, 1*b*, 1*c*, 1*d*, and 1*e*, is shown in its run-in position wherein the latching elements carried thereby for engagement with both the upwardly facing latching surface 1*b* and the downwardly facing latching surface 1*c* of the casing seal bore receptacle, are maintained in a retracted position so that the annular packoff assemblage may be moved through any number of seal bore receptacles until the selected receptacle is reached.

The annular packoff assemblage 2 comprises, in vertically spaced relationship, an upper latching assemblage 10, an intermediate annular sealing assemblage 20, and a lower latching assemblage 30. The three assemblies are interconnected and are run into the well on a tubular mandrel 5 having a polished exterior cylindrical surface 5*a*. The upper portion of tubular mandrel 5 is conventionally connected to the bottom end of a tubular work string (not shown).

Figure 2A:
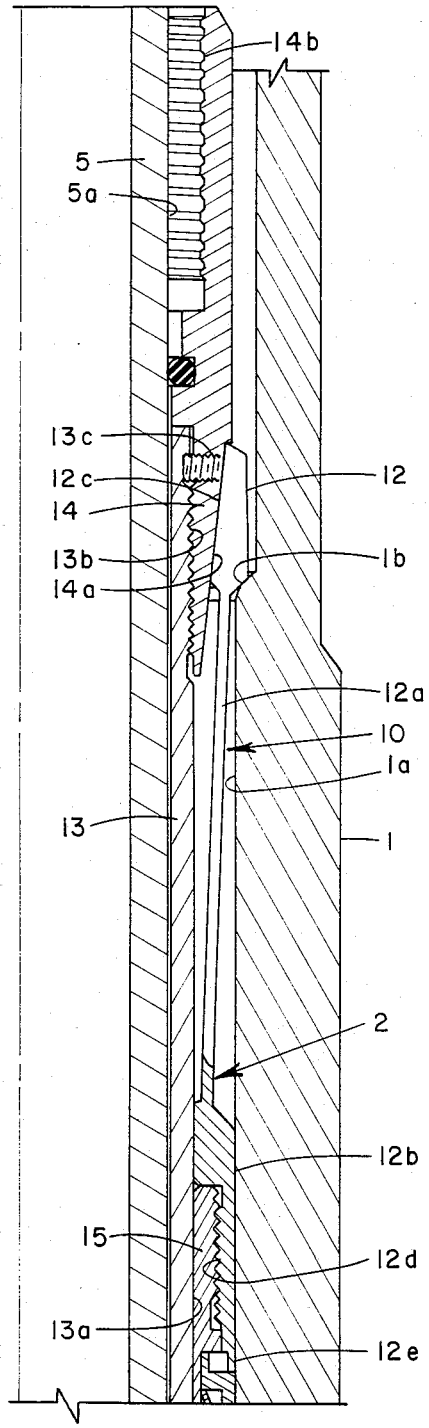
FIGS. 2*a*, 2*b*, and 2*e* are views respectively similar to FIGS. 1*a*, 1*b*, and 1*e*, but illustrating the position of the components of the packoff assemblage when actuated to anchor the selected seal bore receptacle.
Figure 2B:
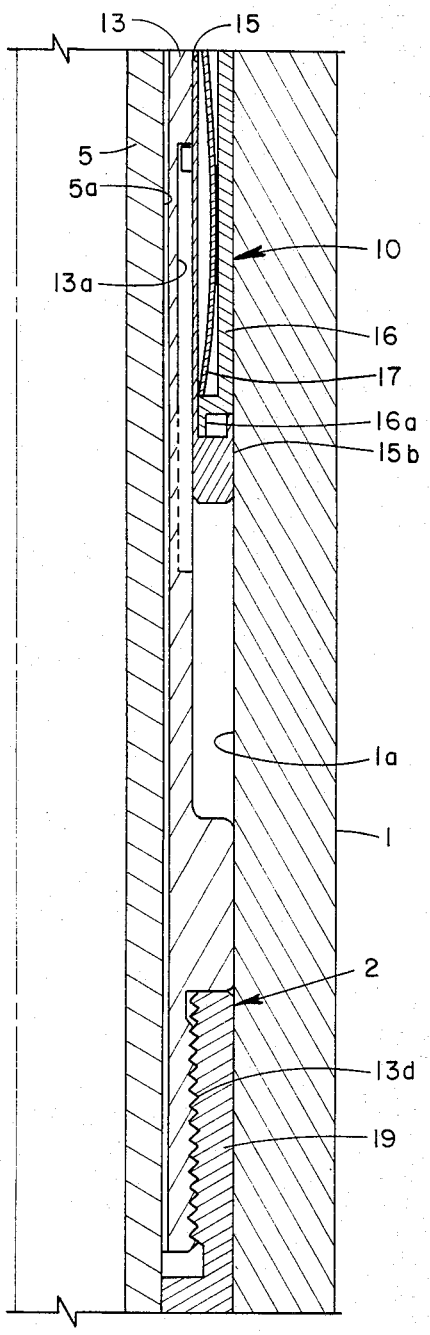
Figure 2E:
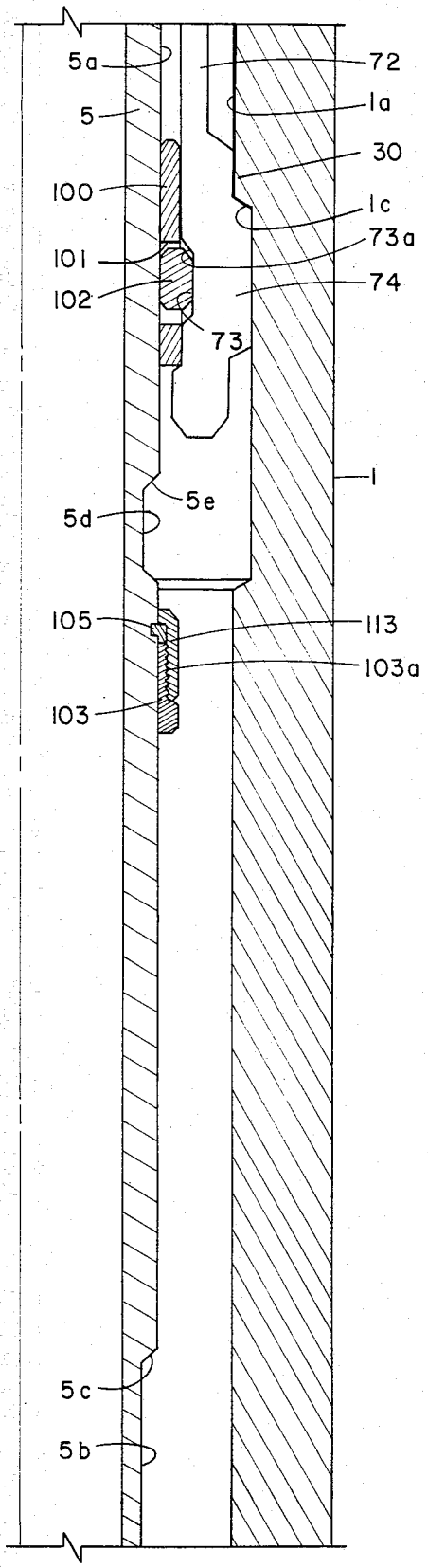

The annular packoff assemblage 2 is run into the well to a position wherein the annular sealing assemblage 20 is centrally disposed adjacent the elongated polished seal bore 1*a* of the receptacle 1. The mandrel 5 is then elevated by the tubular work string, rotated, and then lowered and this sequence of movements effects the release of the upper and lower latching elements respectively carried by the upper latching assembly 10 and the bottom latching assembly 20 so that latching heads 12 of the upper latching assembly 10 engage the upwardly facing stop shoulder 1*b* of the casing bore receptacle 1 (FIG. 2*a*) and the lower latching heads 74 of the lower latching assemblage 30 engage the downwardly facing shoulder 1*c* provided in the seal bore receptacle 1 at the bottom end of the polished bore surface 1*a* (FIG. 2*e*). Latching heads 12 and 74 thus function as radially expansible abutment elements.

The latching heads 12 of the upper latching assemblage 10 comprise radially thickened portions formed on the ends of collet arms 12*a* which are in turn integrally formed with a collet ring portion 12*b* which is mounted in sliding relationship on an external cylindrical surface 13*a* of an inner tubular body 13 which surrounds mandrel 5. The top end of the inner body 13 mounts a camming sleeve 14 which is secured by threads 13*b* and a set screw 13*c* to the end of the inner tubular body 13. The lower portion of the camming sleeve 14 is provided with an upwardly and outwardly inclined camming surface 14*a* which cooperates with correspondingly shaped inner surfaces 12*c* provided on the latching heads 12. Thus, relative movement between latching heads 12 and the inner tubular body 13, including the camming sleeve 14, will produce an outward displacement of the latching heads 12 into a position to engage the upwardly facing shoulder 1*b* in the casing bore receptacle 1, provided that the latching heads 12 are then elevated above such shoulder.

Camming sleeve 14 is further provided at its upper end with a set of normally unused left-hand internal threads 14*b* to permit an emergency retrieval of the annular packoff assemblage.

Ring portion 12*b* of the latching collet is provided with internal threads 12*d* at its lower end which threadably engage the upper end of a drag sleeve 15. The drag sleeve 15 is slidably mounted on the external cylindrical surface 13*a* of inner tubular body 13 and defines an axially extending, peripheral recess 15*a* for mounting of a plurality of drag block segments 16 therein for radial movement. The axial recess 15*a* is overlapped at each axial end by annular ribs 12*e* and 15*b* and these ribs in turn overlap axial projections 16*a* provided on the drag block segments 16. A leaf spring 17 resiliently urges each of the drag blocks 16 into snug sliding engagement with the seal bore surface 1*a* of the seal bore receptacle 1. It is thus assured that whenever downward movement of the inner tubular body 13 occurs relative to the seal bore receptacle, the latching collet is urged upwardly by the frictional drag of the drag blocks 16.

Figure 8:
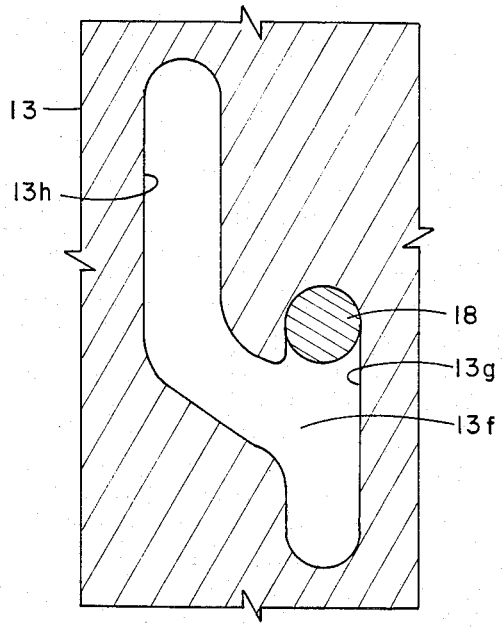
FIG. 8 is a developed view of the J slot provided in the drag sleeve to cooperate with a pin in the inner body.

Such upward relative movement is normally prevented through the cooperation of a J pin 18 mounted in the drag sleeve 15 with a J slot 13*f* formed in the inner body 13 (FIG. 8). In the run-in position of the apparatus, the J pin 18 is disposed in the short arm 13*g* of the J slot 13*f* and hence, the latching heads 12 of the latching collet are held in their retracted position illustrated in FIG. 1*a*. Upward movement of the inner tubular body 13, which is accomplished by the mandrel 5 and the tubular work string in a manner to be hereinafter described, permits the J pin 18 to move to the bottom of the short arm 13*g* of J slot 13*f*, in position to move into the long arm 13*h* through rotation of the inner tubular body 13 by rotation of the tubular work string. Hence, subsequent downward movement of the inner tubular body 13 permits the latching collet to move upwardly relative to the camming surface 14*a*, thus camming the latching heads 12 radially outwardly to engage the upwardly facing latching surface 1*b* of the selected casing seal bore receptacle 1.

A connector sub 19 is secured to external threads 13*d* formed on the bottom end of the inner tubular body 13. Connector sub 19 is in turn threadably connected by external threads 19*a* to the upper end of a tubular body 20*a* of the annular sealing assemblage 20. Such sealing assemblage is provided with a plurality of vertically stacked, annular sealing elements 21 on body 20*a* for effecting a sealing engagement with the receptacle seal bore 1*a*, and is further provided with a plurality of vertically stacked, annular internal sealing elements 22 on body 20*a* for effecting a sealing engagement with the polished exterior mandrel surface 5*a*.

Although various chevron-type sealing assemblies could be employed in the annular packoff unit embodying this invention, the preferred sealing elements comprise a primary elastromeric sealing chevron 34 which can provide adequate sealing integrity in the presence of high pressure differentials and high temperatures. For example, an elastomeric sealing member 34 utilizing a perfluoroelastomer such as the elastomer commonly referred to under the DuPont trademark "Kalrez" can be used effectively in these seal assemblies. Each individual seal assembly also comprises two relatively rigid backup members 36*a* and 36*b* on opposite sides of the primary elastomeric member 34. Backup members 36*a* and 36*b* can comprise material formed generally of polyphenylene sulfide, commonly referred to under the Phillips Petroleum trademark "Ryton". An intermediate back member 38 immediately adjacent to the convex surface of elastomeric member 34 is also shown in each seal assembly used in this invention. This intermediate backup member can comprise a member formed of polytetrafluoroethylene with glass filler material interspersed therein, commonly referred to as a glass filled "Teflon", a trademark of DuPont Corporation.

These chevron-shaped sealing assemblies do not require the application of a mechanical compressive force in order to energize the sealing elements, and such chevron-shaped members generally have a relatively small width. An elastomeric scraper member 46 is also provided, being mounted on the inner surface of the body member 20*a*. The scraper member acts to prevent the buildup of sludge or other material on the outer surface of mandrel 5.

As previously mentioned, the upper portion of mandrel 5 defines a cylindrical polished sealing surface 5*a*. A recessed surface 5*b* is formed adjacent the lower end of mandrel 5. A downwardly facing shoulder 5*c* extends between the mandrel sealing surface 5*a* and the recessed surface 5*b*. In the preferred embodiment depicted in the drawings, mandrel 5 comprises the lowermost section of the tubing string. In alternate embodiments of this invention, not shown specifically herein, additional portions of standard tubing could be connected to the lower portion of the mandrel 5. The length of mandrel 5, and particularly the sealing surface 5*a*, would be determined by the extent of longitudinal movement anticipated for the tubing string in the particular oil well completion. In the most common applications for which this invention would be used, a mandrel section on the order of 20–30 feet in length would be employed.

As previously mentioned, the inner tubular body 13 is initially carried on mandrel 10 by interconnections including lower collet latching heads 74 which have upwardly facing surfaces 74*a* abutting mandrel surface 5*c*, and shear pin 122, as described later.

The annular sealing assembly 20 also comprises a lower body member 50 threadably engaged with the bottom end of the body 20*a* by threads 48. An O-ring seal 56 is positioned along the inner face between the lower surface of the upper packoff body member 20*a* and lower packoff body member 50. Outer and inner seal assemblies 52 and 54, generally equivalent to seal assemblies 21 and 22, are mounted along the lower packoff body member 50 and similarly provide sealing integrity between the polished bore 1*a* of the selected casing bore receptacle 1, mandrel sealing surface 5*a*, and the annular sealing assembly 20.

An annular threaded extension 60 extends from the lower portion of lower body member 50 and has threaded connections 62 and 64 along its outer and inner surfaces respectively. The outer threaded connection 62 engages internal threads 71 formed on the ring portion 70*a* of a lower latching collet member 70 which is part of the lower latching assembly 30. The inner threaded connection 64 engages mating threads on seal retainer 68, which also holds an elastomeric lower scraper member 66 similar to upper scraper member 46.

Figure 1E:
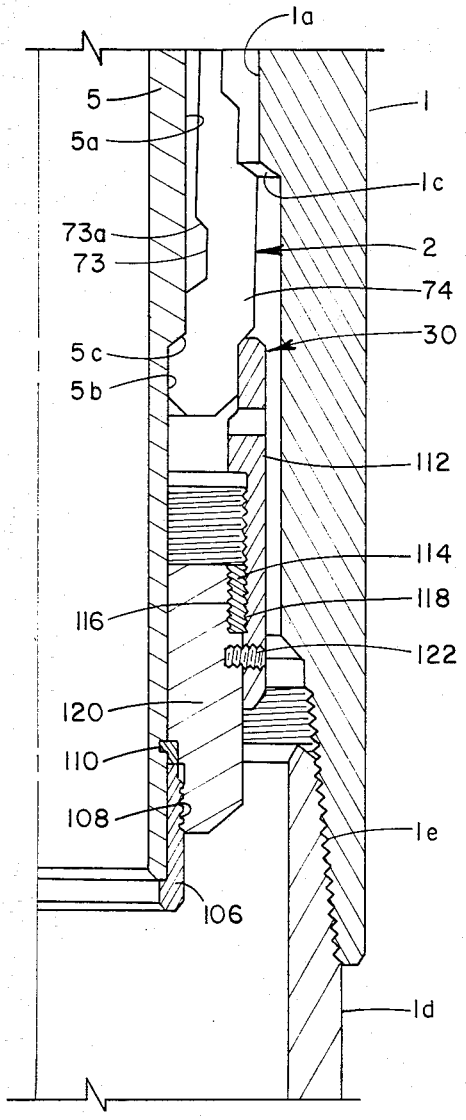

The lower latching collet 70 has a plurality of peripherally spaced, downwardly extending collet arms 72 secured to ring portion 70*a* and terminating in latching head members 74. The head members thus comprise a second radially expandable latching means and are normally spring urged inwardly into a position of abutment with the recessed portion 5*c* of the mandrel 5, as shown in FIG. 1*e*. The latching heads 74 are retained in this position during run in by a disengagable retaining sleeve 112 which is secured by shear pin 122 to an annular guide 120. Guide 120 is secured to the bottom end of the mandrel 5 by a C-ring 110 which is inserted in an appropriate annular recess in the bottom end of the mandrel 5 and is secured to the guide 120 by an externally threaded cap sleeve 106 which snugly surrounds the bottom end of mandrel 5 and is threadably secured to internal threads 108 provided in the bottom end of guide 120. A body lock ring 114 is provided with internal and external wicker threads 116 and 118 which engage corresponding threads respectively provided on the exterior of the top portion of the guide 120 and the interior of the lower portion of the retaining sleeve 112.

Figure 3:
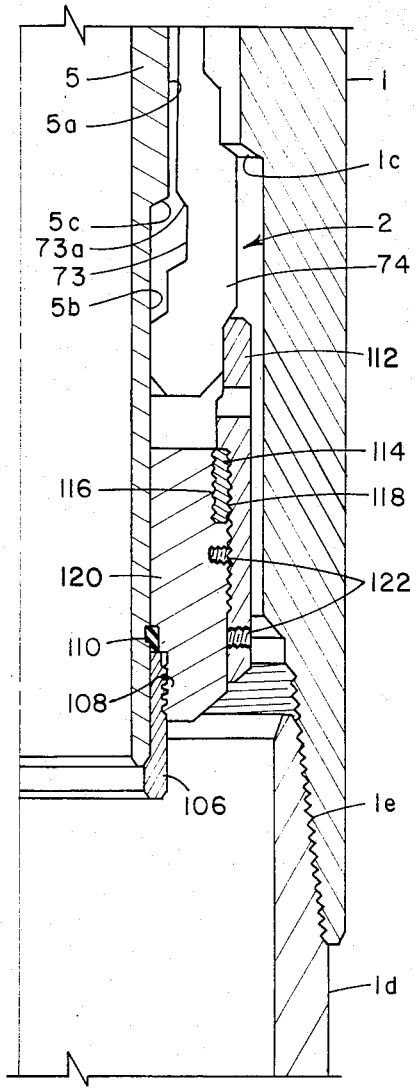
FIG. 3 is a view similar to FIG. 1*e*, but illustrating the effect of upward movement of the mandrel.

When the aforedescribed packoff assemblage has been run into the well to the position relative to a selected casing bore receptacle 1 illustrated in FIGS. 1*a*–1*e*, the collet locking heads 74 are disposed just below and in the vicinity of the downwardly facing locking shoulder 1*c* provided in the casing bore receptacle 1. Since the annulus between the mandrel 5 and the casing bore receptacle 1 is sealed by the respective engagement of the seal assemblages 21, 22, 52, and 54 carried by the body member 20*a* with the exterior of the mandrel 5 and seal bore surface 1*a*, fluid pressure may be applied to such annular sealing assemblage 20 to produce an effective downward force thereon, hence, securing the collet 70 and all interconnected apparatus in the aforedescribed position. The same fluid pressure force is utilized to move tubular body 13 downwardly relative to drag sleeve 15. Upward movement of mandrel 5 produced by the tubing string will thus effect the shearing of shear pin 122 and upward movement of guide sleeve 120 with respect to the retaining sleeve 112. The effect of the upward movement of mandrel 5 is illustrated in FIG. 3, wherein it will be seen that the guide sleeve 120 has advanced upwardly relative to the retaining sleeve 112 and is secured in its upwardly displaced position by the wicker threads 116 and 118. Hence, upon subsequent downward movement of the mandrel 10, the top end of the retaining sleeve 112 is removed from engagement with the locking heads 74 of collet 70 and such heads are free to be moved outwardly into engagement with the downwardly facing shoulder 1*c* of the casing bore receptacle 1.

Such outward displacement of the locking heads 74 is initially effected by the downwardly facing shoulder 5*c* provided at the top of the recess mandrel portion 5*b*. As the mandrel 5 is moved further downwardly relative to the collet 70, a locking dog support sleeve 100 is moved beneath the inner ends of the collet locking heads 74. The locking dog support sleeve 100 surrounds mandrel 5 and is provided with a plurality of peripherally spaced apertures 101 for respectively accommodating a plurality of radially shiftable locking dogs 102. In the run-in position of the apparatus illustrated in FIGS. 1*a*–1*e*, the locking dogs are retained within a mandrel recess 5*d* by the abutting engagement of the collet locking arms 72.

The locking dog support sleeve 100 is positioned on mandrel 5 in the vicinity of the locking dog recess 5*d* by a split retaining ring 103 which is held in position by a shear ring 105 located within a cooperable recess on the surface of mandrel 5. Internal retaining ring 103 is externally threaded as indicated at 103*a* and an internally threaded retaining ring 113 is engaged with such threads. It should be noted that the top end surface 100*a* of the locking dogs support sleeve 100 is spaced below the end face 68*a* of the seal retainer 68 (FIG. 1*d*) thus permitting a limited amount of upward relative movement of the mandrel 5 with respect to the annular packoff assemblage 2 for the purposes that were heretofore described. As the mandrel 5 is moved downwardly, a downwardly facing shoulder on support sleeve 100 engages a cooperable surface on the interior of collet head 74 to position the sleeve 100 between the mandrel 5 and collet head 74. The locking dogs 102 are aligned with a recess 73 provided in the interior surfaces of locking heads 74 and move outwardly into such recesses under the camming action of the inclined mandrel shoulder 5*e* provided at the top of the dog receiving mandrel recess 5*d*. Hence the collet locking heads 74 are retained in their outwardly displaced or set position with the locking dogs 102 positioning the sleeve 100 between the latching collet heads 74 and mandrel 5, wherein the packoff assemblage 2 is secured to the casing bore receptacle 1 against upward movement.

The same upward and downward movements of the mandrel 5, plus the intermediate rotation, produce the outward camming of the upper latching heads 12 and secure their engagement with the upwardly facing shoulder 1*b* provided on the casing bore receptacle 1 (FIGS. 2*a*–2*e*). The mandrel 5 may then be moved freely relative to the packoff assembly without disturbing the packoff seals, and is normally moved downwardly to position the polished surface 5*a* centrally relative to the inner seal stacks 21 and 54. The contraction or expansion of the tubing string in response to temperature variation or other causes is readily permitted by vertical movement of the mandrel 5 without in any manner disturbing the effectiveness of the seal provided by the annular packoff assembly 2. Obviously, the length of the polished mandrel surface 5*a* substantially exceeds the length of the seals of the packoff assembly 2, as shown in FIGS. 1*a*–1*e*.

In such set position, the locking collet heads 74 are radially supported by sleeve 100. If axial forces are transmitted to the collet 70, an inward camming force on the collet heads 74 will be established. The collet heads 74 will be supported by sleeve 100 rather than the polished mandrel surface 5*a*. Thus, the polished surface 5*a* of mandrel 5 will not be damaged as the mandrel shifts relative to the collet heads 74, either as the result of movement of the mandrel, or of expansion or contraction of the mandrel.

Figure 4:
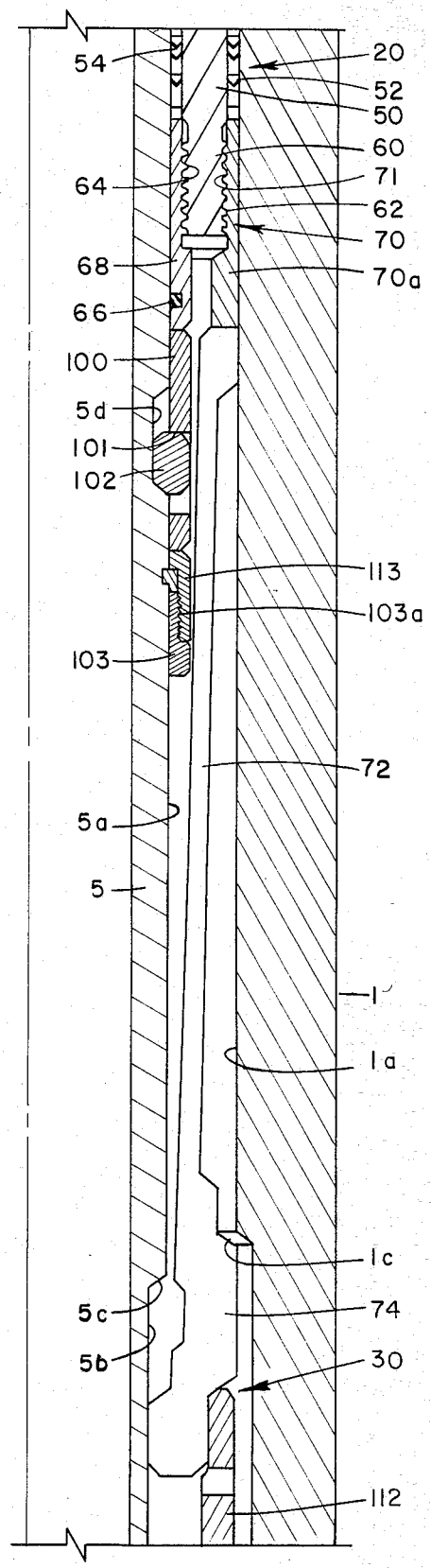
FIG. 4 is a view similar to FIG. 1*e*, but illustrating the position of the components during extraction of the packoff assemblage.
Figure 5:
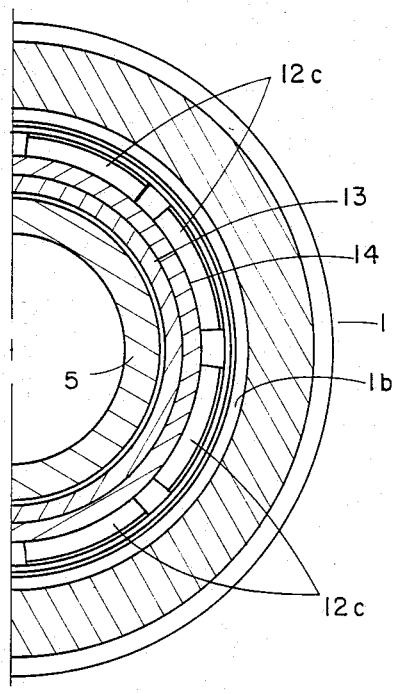
FIG. 5 is a sectional view taken on the plane 5—5 of FIG. 1*a*.
Figure 6:
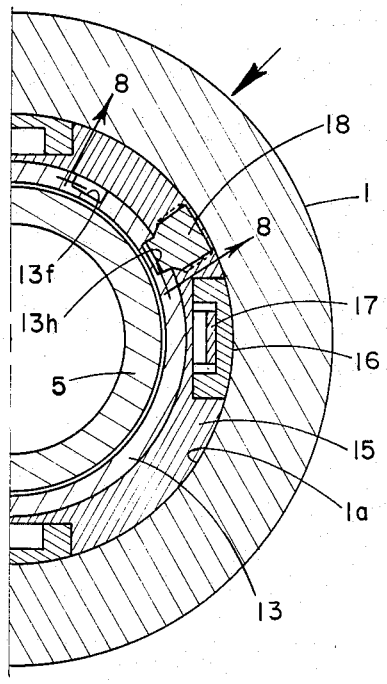
FIG. 6 is a sectional view taken on the plane 6—6 of FIG. 1*b* or FIG. 9*b*.
Figure 7:
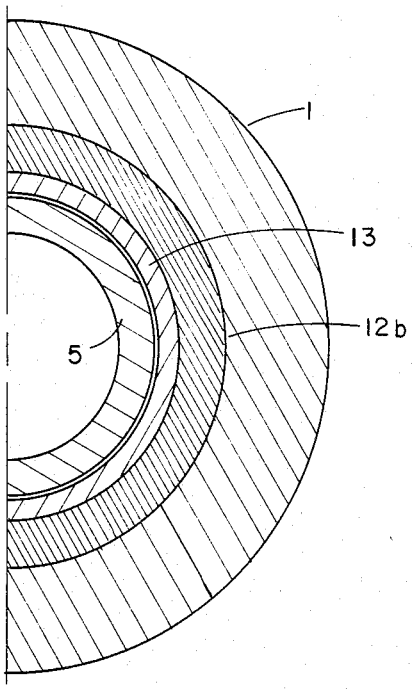
FIG. 7 is a sectional view taken on the plane 7—7 of FIG. 1*a*.

When, for any reason, it is desired to extract the aforedescribed packoff assemblage from the well, this may be readily done by applying an upward force to the mandrel 5 by the tubing string. As the mandrel 5 moves upwardly, the locking dog recess 5*d* in mandrel 5 is aligned with the radially expanded locking dogs 102 and they are moved into the respective locking dog recesses by the camming action of recess shoulder 5*e*. The collet locking heads 74 are thus freed from engagement with the downwardly facing shoulder 1*c* of the casing bore receptacle 1. The locking dog support sleeve 100 is then moved upwardly with the mandrel 5 and the top end face of locking dog support sleeve 100 engages the bottom end face 68*a* of seal retainer 68, thus applying a direct extraction force through the threaded connection 64 to the annular packoff assemblage 2 (FIG. 4). Accordingly, the extraction of the annular packoff assemblage does not involve the application of any significant force to the collet arms 72.

The aforedescribed upward removal movement of the mandrel 5 is not in any manner prevented by the upper latching assemblage 10. When, however, sufficient movement has occurred to bring the latching heads 12 of the upper latching assemblies 10 into engagement with the downwardly facing shoulder on the next seal bore receptacle positioned above the selected receptacle, such engagement pushes the latching heads 12 down the inclined cam surface 14*a* of the camming sleeve 14 to the retracted position shown in FIG. 1A. A slight turning movement of the mandrel 5 produced by the tubular work string can then transfer the J slot pin 18 into engagement with the short arm portion 15*d* of the J slot 15*c* and thus restore the upper latching assemblage to its original run-in position, permitting unrestricted upward movement of the entire assemblage through any number of casing bore receptacles positioned above the selected receptacle.

Figure 9A:
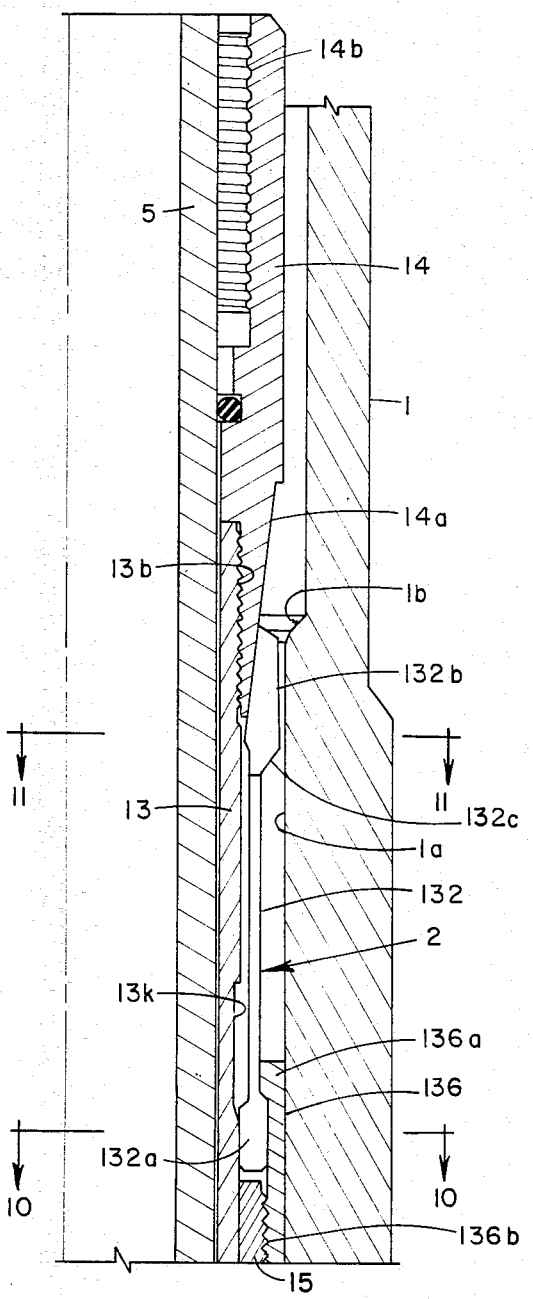
FIGS. 9*a* and 9*b* collectively represent a modified form of upper latching mechanism for the annular packoff assemblage, with the components thereof shown in their run-in position relative to a selected casing seal bore receptacle.
Figure 9B:
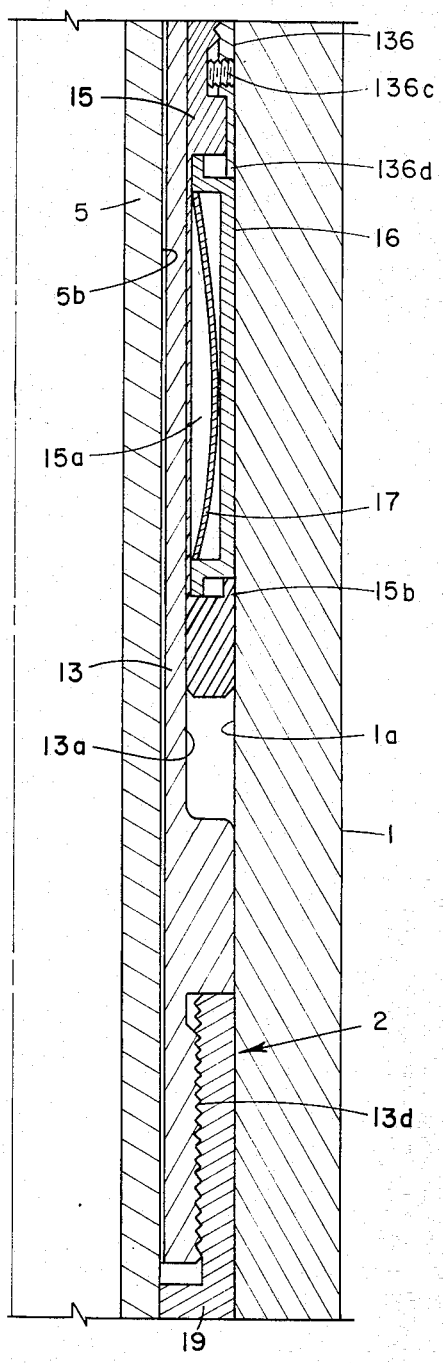
Figure 10:
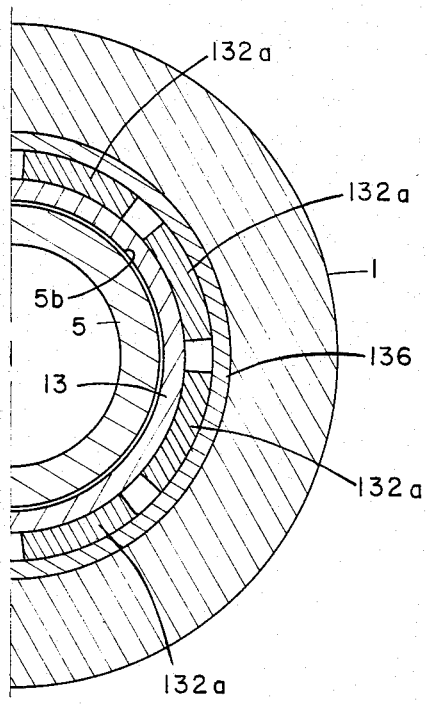
FIG. 10 is a sectional view taken on the plane 10—10 of FIG. 9*a*.
Figure 11:
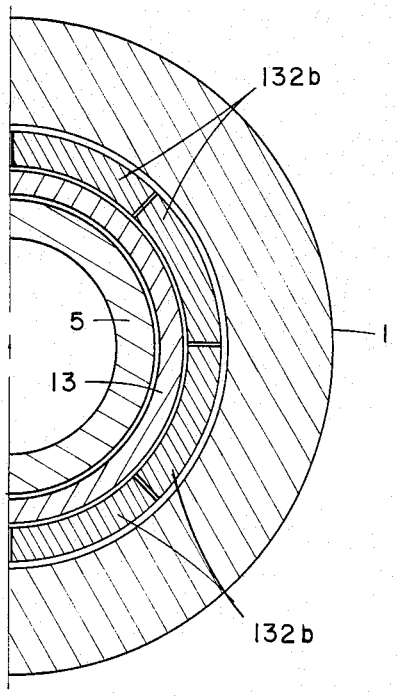
FIG. 11 is a sectional view taken on the plane 11—11 of FIG. 9*a*.
Figure 15:
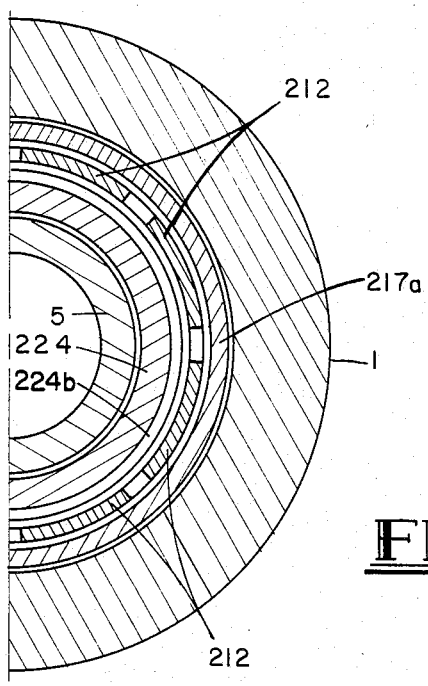
FIG. 15 is a sectional view taken on the plane 15—15 of FIG. 13*b*.

Referring now to FIGS. 9*a* and 9*b*, wherein similar numerals indicate parts identical to those previously described, there is shown a modification of this invention wherein the upper latching mechanism comprises a plurality of peripherally spaced latching levers 132 of segment shaped cross-section, Such levers are held in peripherally spaced relationship around the inner body 13 by an axial extension 136*a* of a retaining sleeve 136 which is secured by internal threads 136*b* to the upper end of the drag sleeve 15. A set screw 136*c* secures this threaded connection. An annular lip 136*d* overlies the drag block recess 15*a*. The extension 136*a* is internally contoured to fit over the bulbous lower end portions 132*a* of the latching levers 132.

The upper ends of the segmented latching levers 132 are provided with radially enlarged latching portions 132*b* having a downwardly facing inclined surface 132*c* which is designed to cooperate with the upwardly facing latching surface 1*b* provided on the casing bore receptacle 1. In the run-in position shown in FIGS. 9*a* and 9*b*, the segmented latching levers 132 are firmly trapped in a retracted position, thus permitting the ready insertion of the packoff assemblage 2 through any desired number of casing bore receptacles until the selected casing receptacle 1 is reached. The lower portion of the packoff assembly 2 is identical to that previously described, including a sealing assemblage 20 and a lower latching mechanism 30, hence these components are not shown nor will they be again described.

A J slot connection similar to that previously described is provided between the tubular inner body 13 and the drag sleeve 15 so as to maintain the retaining sleeve 136 in the retracted position of the latching levers 112 until the tubing string is elevated, then rotated and then moved downwardly.

Figure 12A:
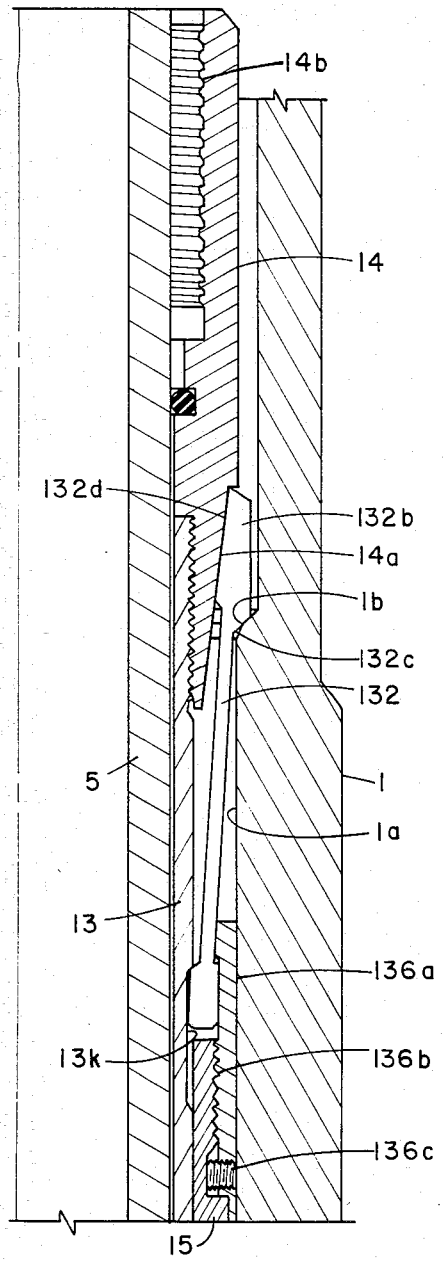
FIGS. 12*a* and 12*b* respectively correspond to FIGS. 9*a* and 9*b*, but showing the components of the upper latching assemblage in their latched position with respect to the selected casing seal bore receptacle.
Figure 12B:
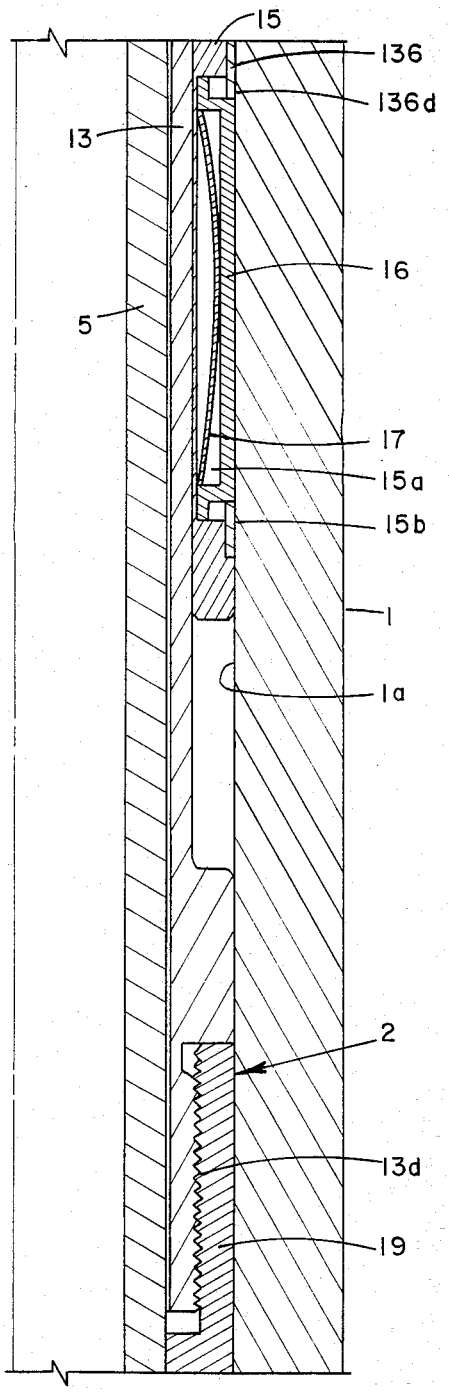

Such action shifts the components in the manner illustrated in FIGS. 12*a* and 12*b*. The bulbous retaining heads 132*a* are moved into an annular recess 13*k* provided in the inner body member 13 so as to permit the latching lever to be cammed outwardly by the engagement of the camming surface 14*a* with the corresponding surface 132*d* provided on the latching heads 132*b*. Thus, latching heads 132*b* are moved outwardly into latching engagement with the upwardly facing shoulder 1*b* provided in the selected seal bore receptacle 1. The operation of the lower latching mechanism is identical to that previously described and is effected by the upward and downward movement of the tubular work string and mandrel 5 and is not in any way adversely affected by the turning movement required to transfer the J pin into the axially longer portion of the J slot.

Figure 13A:
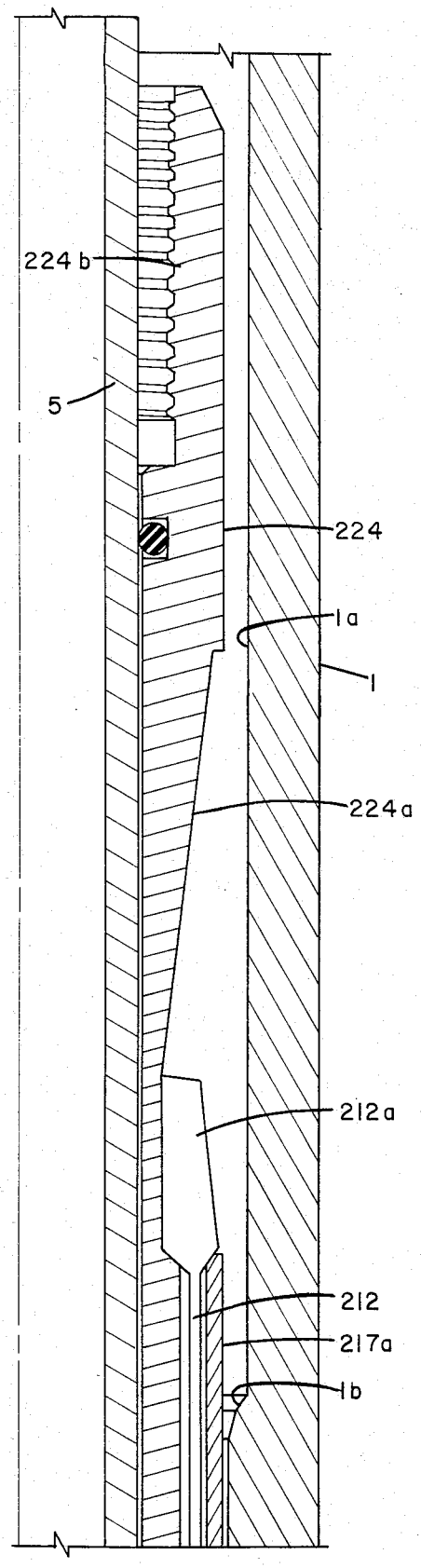
FIGS. 13*a* and 13*b* illustrate a further modification of this invention of an annular packoff assemblage wherein the upper latching elements are hydraulically actuated to assume their latching position, the components thereof being shown in their unlatched retracted position with respect to a selected casing seal bore receptacle.
Figure 13B:
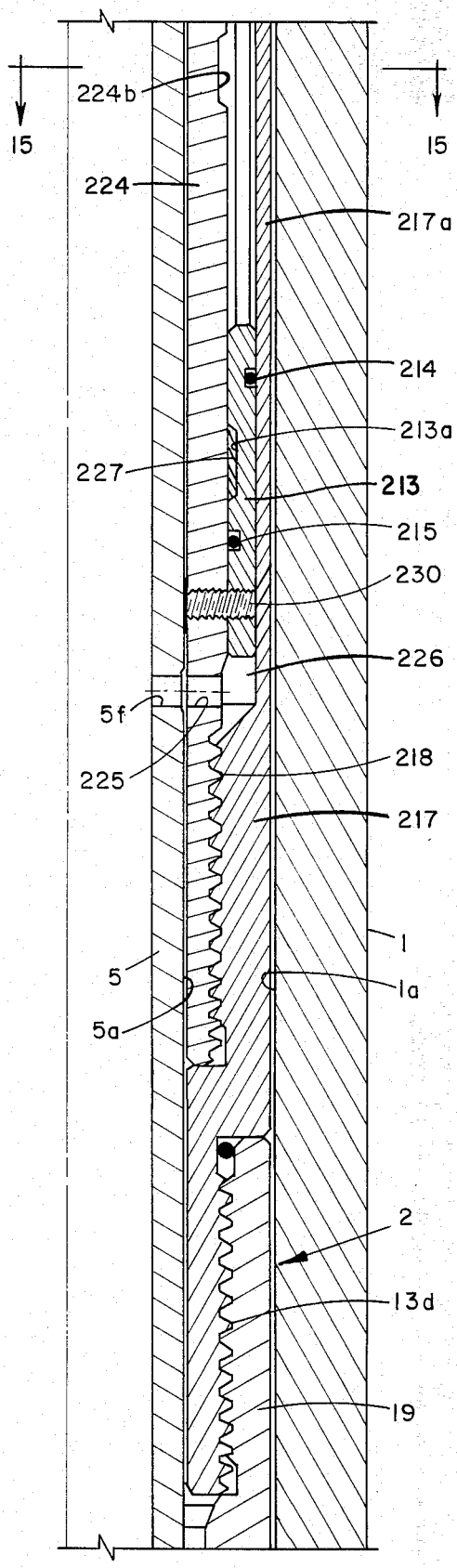

Referring now to FIGS. 13*a* and 13*b*, there is shown a further modification of this invention wherein the upper latching elements are hydraulically actuated to their latching position. The latching with the upwardly facing surface 1*b* of the selected casing bore receptacle 1 is accomplished by a latching collet 212 having its body ring formed as an annular piston 213. O-ring seals 214 and 215 are provided on the piston 213 to respectively cooperate with the internal surface of an axial extension 217*a* of a connector sub 217 and with the exterior surface of a camming sleeve 224 which is threadably secured by threads 218 to the connector sub 217. A radial port 5*f* is provided in the wall of the mandrel 5 and communicates with an aligned port 225 provided in the wall of the camming sleeve 224. Such ports communicate with an annular fluid pressure chamber 226 defined at the base of the collet piston element 213 and, when supplied with fluid pressure through the tubular work string, operates on the annular piston element 213 to move it upwardly, thus removing the enlarged latching heads 212*a* provided on the upper end of the collet 213 out of restrained engagement by the axial extension portion 217*a* of the connector sub 217. Such fluid pressure may be provided in conventional fashion by temporarily inserting a blanking plug in the bore of the mandrel 5, or there may be an expendable ball seat (not shown) mounted in the bore of mandrel 5 below the port 5*f*. Thus, the fluid pressure may be transmitted from the tubular work string to the bore of hollow mandrel 5 and thence through the ports 5*f* and 225 to operate on the bottom end of the piston portion 213 of the collet 212. A shear screw 230 holds the assembly in the run-in position until sheared by application of fluid pressure.

Figure 14A:
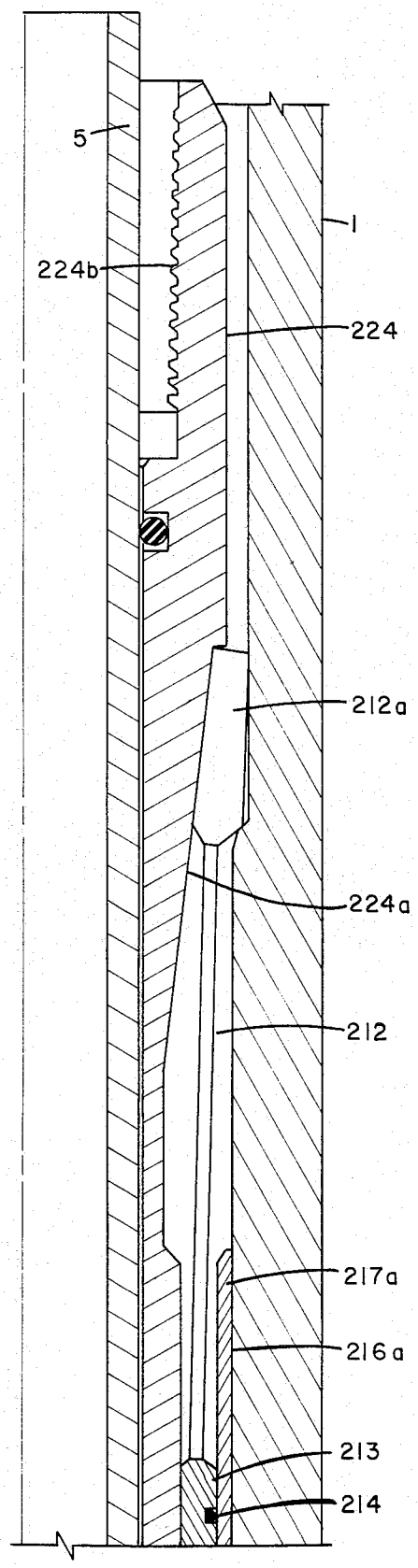
FIGS. 14*a* and 14*b* respectively correspond to FIGS. 13*a* and 13*b*, but showing the components thereof in their latched positions with respect to the selected seal bore receptacle.
Figure 14B:
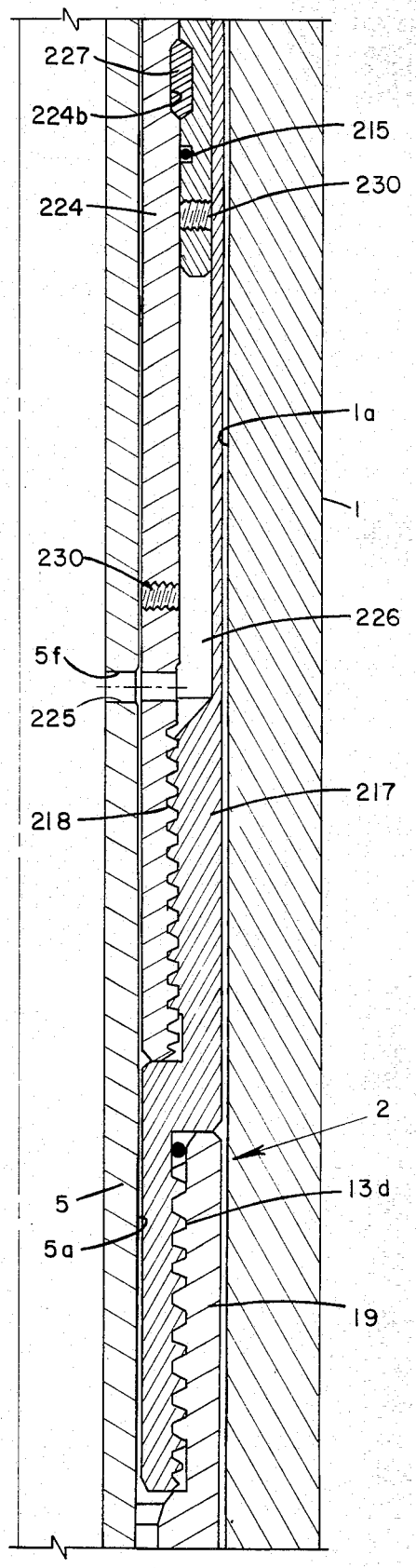

The components then assume the position shown in FIGS. 14*a* and 14*b*, wherein the collet 212 is advanced upwardly to move the latching heads 212*a* of the collet into camming engagement with the camming surface 224*a* of camming sleeve 224, thereby urging the latching heads 212*a* outwardly into latching engagement with the upwardly facing surface 1*b* of the selected casing bore receptacle 1. The components are secured in this position by a C-ring 227 carried internally by collet piston 213, which snaps into a recess 224*b* provided on camming sleeve 224.

The necessary raising and lowering movements of the mandrel 5 to effect the setting of the lower latching mechanism 30 can then be effected without any interference from the hydraulically set latching collet 213, since this imposes no restraint upon the upward movement of the assemblage. After the short initial upward movement of the assemblage, the mandrel is freed from the packoff assemblage through the shearing of pins 122 in the manner heretofore described and hence can be moved downwardly to effect the setting of the lower latching mechanism 30.

Although the invention has been described in terms of specified embodiments which are set forth in detail, it should be understood that this is by illustration only and that the invention is not necessarily limited thereto, since alternative embodiments and operating techniques will be come apparent to those skilled in the art in view of the disclosure. Accordingly, modifications are contemplated which can be made without departing from the spirit of the described invention.

What is claimed and desired to be secured by Letters Patent is:

1. A packoff assembly for cooperation with a selected one of a plurality of polished bore receptacles incorporated in spaced relationship in a well casing string, each receptacle having a polished bore and upwardly and downwardly facing shoulders respectively above and below the polished bore; a tubular mandrel connectable to a tubular conduit extending to the well surface; a tubular body assemblage surrounding said mandrel and releasably connected thereto; seal means on said tubular body assemblage for establishing sealing integrity between the exterior of said mandrel and the polished bore of a selected receptacle; a first normally contracted, radially expansible abutment element mounted on the upper portion of said tubular body assemblage; means on said tubular body assemblage for radially expanding said first abutment element to engage the upwardly facing shoulder on the selected polished bore receptacle; a second normally contracted radially expansible abutment element on the lower portion of said tubular body assemblage; and means responsive to axial movement of said mandrel for radially expanding said second abutment element to engage the downwardly facing surface on the selected polished bore receptacle; thereby anchoring said tubular body assemblage to the selected polished bore receptacle independently of said mandrel and permitting axial movements of said mandrel relative to the polished bore receptacle while sealing the annulus between said mandrel and the polished bore receptacle.

2. The packoff assembly of claim 1 wherein said first normally contracted, radially expansible abutment element comprises a plurality of peripherally spaced, longitudinally extending arms; means for mounting said arms in surrounding relation to the tubular body assemblage and axially movable relative thereto; an annular cam surface on said tubular body assemblage underlying the one end portions of said arms to move said one end portions outwardly to engage the upwardly facing shoulder of the selected receptacle upon axial movement of said arms in one direction relative to said tubular body assemblage; and means operable from the well surface for producing said relative axial movement of said arms in said one direction.

3. The packoff assembly of claim 2 further comprising an annular retainer member mounted on said tubular body assemblage and overlying the other end portions of said arms to retain same in said retracted position, said arms being disengagable from said annular retainer member by said relative movement of said arms in said one direction.

4. The packoff assembly of claim 2 wherein said arms constitute the arm portions of a collet having a ring portion slidably mounted on said tubular body assemblage.

5. The packoff assembly of claim 2 wherein said arms comprises segment shaped members mounted in an annular space between said tubular body assemblage and the polished bore of the selected polished bore receptacle; an annular drag block surrounding said tubular body assemblage; a retaining ring carried by said drag block and surrounding the other ends of said segment shaped arms to secure same in said radially retracted position; and means operable from the well surface for producing relative axial movement of the tubular body assembly and said segment shaped arms in said one direction to disengage from said retaining ring and expand said one end portions outwardly to engage the upwardly facing shoulder of the selected receptacle.

6. The packoff assembly of claim 2 wherein said arms are operatively connected to an annular piston disposed in a fluid pressure chamber defined between said annular retainer member and said tubular body assemblage; and said means operable from the well surface comprises a conduit interconnecting said fluid pressure chamber with the bore of the tubular mandrel to receive pressured fluid from the surface through the tubular conduit.

7. The packoff assembly of claim 3 wherein said arms are operatively connected to an annular piston disposed in a fluid pressure chamber defined between said annular retainer member and said tubular body assemblage; and said means operable from the well surface comprises a conduit interconnecting said fluid pressure chamber with the bore of the tubular mandrel to receive pressured fluid from the surface through the tubular conduit.

8. The packoff assembly of claim 6 further comprising means for latching said annular piston against axial movement at the end of its stroke in said one direction.

9. A packoff assembly in accordance with claim 1 wherein said second radially expansible element comprises a collet having a ring portion mounted on said tubular body assemblage and locking arm portions surrounding said mandrel in a radially retracted position; and means responsive to vertical movement of said mandrel relative to said tubular body assemblage for displacing said locking arm portions radially outwardly to engage the downwardly facing shoulder of the selected polished bore receptacle.

10. The packoff assembly of claim 1 wherein said second radially expansible abutment element is expandable only after expansion of said first radially expansible abutment element.

11. A subterranean well completion apparatus comprising, in combination, a plurality of seal bore receptacles threadably incorporated in a first tubular conduit as pre-selected intervals, each seal bore receptacle having a polished bore and an upwardly facing shoulder adjacent the polished bore, the polished bore in all of the plurality of seal bore receptacles having the same inner diameter, a tubular mandrel connectable to a second tubular conduit extending to the well surface; a tubular body assemblage surrounding said mandrel and shearably connected thereto; seal means on the tubular body assemblage for establishing sealing integrity between the exterior of said mandrel and the polished bore of a selected receptacle, whereby the application of fluid pressure to said seal means while raising said mandrel releases said mandrel from said tubular body assemblage; a first normally contracted, radially expansible abutment element mounted on said tubular body assemblage; and means on said tubular body assemblage for radially expanding said first abutment element to engage the upwardly facing shoulder on the selected polished bore receptacle.

12. A subterranean well completion apparatus comprising, in combination, a plurality of seal bore receptacles threadably incorporated in the casing string at preselected intervals, each seal bore receptacle having a polished bore and upwardly and downwardly facing shoulders respectively above and below the polished bore; a tubular mandrel connectable to a tubular conduit extending to the well surface; a tubulaar body assemblage surrounding said mandrel and shearably connected thereto; seal means on said tubular body assemblage for establishing sealing integrity between the exterior of said mandrel and the polished bore of a selected receptacle, whereby the application of fluid pressure to said seal means while raising said mandrel releases said mandrel from said tubular body assemblage; a first normally contracted, radially expansible abutment element mounted on the upper portion of said tubular body assemblage; means on said tubular body assemblage for radially expanding said first abutment element to engage the upwardly facing shoulder on the selected polished bore receptacle; a second normally contracted radially expansible abutment element on the lower portion of said tubular body assemblage; and means responsive to axial movements of said mandrel relative to said tubular body assemblage for radially expanding said second abutment element to engage the downwardly facing surface on the selected polished bore receptacle, thereby anchoring said tubular body assemblage to the selected polished bore receptacle independently of said mandrel and permitting axial movements of said mandrel relative to the polished bore receptacle while sealing the annulus between said mandrel and the polished bore receptacle.

13. The apparatus of claim 12 wherein said first normally contracted, radially expansible abutment element comprises a plurality of peripherally spaced, longitudinally extending arms; means for mounting said arms in surrounding relation to the tubular body assemblage and axially movable relative thereto; an annular cam surface on said tubular body assemblage underlying the one end portions of said arms to move said one end portions outwardly to engage the upwardly facing shoulder of the selected receptacle upon axial movement of said arms in one direction relative to said tubular body assemblage; and means operable from the well surface for producing said relative axial movement of said arms in said one direction.

14. The apparatus of claim 13 further comprising an annular retainer member mounted on said tubular body assemblage and overlying the other end portions of said arms to retain same in said retracted position, said arms being disengagable from said annular member by said relative movement of said arms in said one direction.

15. The apparatus of claim 14 wherein said arms are operatively connected to an annular piston disposed in a fluid pressure chamber defined between said annular retainer member and said tubular body assemblage; and said means operable from the well surface comprises a conduit interconnecting said fluid pressure chamber with the bore of the tubular mandrel to receive pressured fluid from the surface through the tubular conduit.

16. The apparatus of claim 13 wherein said arms constitute the arm portions of a collet having a ring portion slidably mounted on said tubular body assemblage.

17. The apparatus of claim 13 wherein said arms comprise segment shaped members mounted in an annular space between said tubular body assemblage and the polished bore of the selected polished bore receptacle; an annular drag block surrounding said tubular body assemblage; a retaining ring carried by said drag block and surrounding the other ends of said segment shaped arms to secure same to said tubular body assemblage in said radially retracted position; and means operable from the well surface for producing relative axial movement of said tubular assemblage and segment shaped arms in a direction to disengage said arms from said ring and by movement in the opposite direction to expand said one end portions outwardly to engage the upwardly facing shoulder of the selected receptacle.

18. The apparatus of claim 13 wherein said arms are operatively connected to an annular piston disposed in a fluid pressure chamber defined on said tubular body assemblage; and said means operable from the well surface comprises a conduit interconnecting said fluid pressure chamber with the bore of the tubular mandrel to receive pressured fluid from the surface through the tubular conduit.

19. The apparatus of claim 18 further comprising means for latching said annular piston against axial movement at the end of its stroke in said one direction.

20. A packoff assembly for cooperation with a selected one of a plurality of polished bore receptacles incorporated in spaced relationship in a well casing string, each receptacle having a polished bore and upwardly and downwardly facing shoulders respectively above and below the polished bore; a tubular mandrel connectable to a tubular conduit extending to the well surface; a tubular body assemblage surrounding said mandrel; interconnecting means for releasably securing said tubular body assemblage to said mandrel for run in; interior and external seal means on said tubular body assemblage for establishing sealing integrity between the exterior of said mandrel and the polished bore of a selected receptacle; said interconnecting means being released by application of fluid pressure to said external seal means while said mandrel is raised; a first normally contracted, radially expansible abutment element mounted on the upper portion of said tubular body assemblage; means on said tubular body assemblage for radially expanding said first abutment element to engage the upwardly facing shoulder on a selected polished bore receptacle; a second normally contracted radially expansible abutment element on the lower portion of said tubular body assemblage; and means for radially expanding said second abutment element to engage the downwardly facing surface on the selected polished bore receptacle, thereby anchoring said tubular body assemblage to the selected polished bore receptacle independently of said mandrel and permitting axial movements of said mandrel relative to said selected receptacle while sealing the annulus between said mandrel and the selected polished bore receptacle.

21. The packoff assembly of claim 20 wherein said first normally contracted, radially expansible abutment element comprises a plurality of peripherally spaced, longitudinally extending arms; means for mounting said arms in surrounding relation to the tubular body assemblage and axially movable relative thereto; an annular cam surface on said tubular body assemblage underlying the one end portions of said arms to move said one end portions outwardly to engage the upwardly facing shoulder of the selected receptacle upon axial movement of said arms in one direction relative to said tubular body assemblage; and means operable from the well surface for producing said relative axial movement of said arms in said one direction.

22. The packoff assembly of claim 21 further comprising an annular retainer member mounted on said tubular body assemblage and overlying the other end portions of said arms to retain same in said retracted position, said arms being disengagable from said annular member by said relative movement of said arms in said one direction.

23. The packoff assembly of claim 22 wherein said arms are operatively connected to an annular piston disposed in a fluid pressure chamber defined between said annular retainer member and said tubular body assemblage; and said means operable from the well surface comprises a conduit interconnecting said fluid pressure chamber with the bore of the tubular mandrel to receive pressured fluid from the surface through the tubular conduit.

24. The packoff assembly of claim 23 further comprising an annular retainer member mounted on said tubular body assemblage and overlying the other end portions of said arms to retain same in said retracted position, said arms being disengagable from said annular member by said relative movement of said arms in said one direction.

25. The packoff assembly of claim 21 wherein said arms constitute the arm portions of a collet having a ring portion slidably mounted on said tubular body assemblage.

26. The packoff assembly of claim 21 wherein said arms comprise segment shaped members mounted in an annular space between said tubular body assemblage and the polished bore of the selected polished bore receptacle; an annular drag block surrounding said tubular body assemblage, a retaining ring carried by said drag block and surrounding the other ends of said segment shaped arms to secure same to said tubular body assemblage in said radially retracted position; and means operable from the well surface for producing said relative axial movement of said tubular body assemblage and said segment shaped arms in said one direction to disengage from said retaining ring and expand said one end portions outwardly to engage the upwardly facing shoulder of the selected receptacle.

27. The packoff assembly of claim 21 wherein said arms are operatively connected to an annular piston disposed in a fluid pressure chamber defined in said tubular body assemblage; and said means operable from the well surface comprises a conduit interconnecting said fluid pressure chamber with the bore of the tubular mandrel to receive pressured fluid from the surface through the tubular conduit.

28. The packoff assembly of claim 20 wherein a drag sleeve is mounted on said tubular body assemblage for relative axial movements; means on said drag sleeve for frictionally engaging the seal bore of the selected receptacle to move said drag sleeve in one direction relative to said tubular body assemblage; means operatively connecting said drag sleeve to said first radially expansible abutment element to expand same by said movement in said one direction; said drag sleeve mounting a J pin; a J slot defined in said tubular body assemblage and cooperating with said J pin to limit movement of said drag sleeve in said one direction until said mandrel is raised, turned and then lowered by the tubular conduit.

29. The packoff assembly of claim 20 wherein said first normally contracted, radially expansible abutment element comprises a plurality of peripherally spaced, longitudinally extending arms; means for mounting said arms in surrounding relation to the tubular body assemblage and axially movable relative thereto; an annular cam surface on said tubular body assemblage underlying the one end portions of said arms to move said one end portions outwardly to engage the upwardly facing shoulder of the selected receptacle upon axial movement of said arms in one direction relative to said tubular body asemblage; a drag sleeve mounted on said tubular body assemblage for relative axial movements; means on said drag sleeve for frictionally engaging the seal bore of the selected receptacle to move said drag sleeve in one direction relative to said tubular body assemblage; means operatively connecting said drag sleeve to said arms to retain same in a retracted position for run in until said drag sleeve moves in said one direction; said drag sleeve mounting a J pin; a J slot defined in said tubular body assemblage and cooperating with said J pin to limit movement of said drag sleeve in said one direction until said mandrel is raised, turned and then lowered by the tubular conduit.

* * * * *